US008465064B2

(12) United States Patent
Ghannam

(10) Patent No.: US 8,465,064 B2
(45) Date of Patent: Jun. 18, 2013

(54) VEHICLE DOOR LATCHING ASSEMBLY INCLUDING LATCH ROD DECOUPLING MECHANISM

(75) Inventor: Mahmoud Yousef Ghannam, Windsor, CA (US)

(73) Assignee: Ford Global Technologies, LLC, Dearborn, MI (US)

( * ) Notice: Subject to any disclaimer, the term of this patent is extended or adjusted under 35 U.S.C. 154(b) by 1610 days.

(21) Appl. No.: 11/162,875

(22) Filed: Sep. 27, 2005

(65) Prior Publication Data

US 2007/0069525 A1 Mar. 29, 2007

(51) Int. Cl.
*E05B 3/00* (2006.01)
*E05B 65/10* (2006.01)

(52) U.S. Cl.
USPC .... 292/336.3; 292/92; 292/216; 292/DIG. 65

(58) Field of Classification Search
USPC ..... 292/92, 216, 336.3, DIG. 23, DIG. 65
See application file for complete search history.

(56) References Cited

U.S. PATENT DOCUMENTS 3,228,719 A * 1/1966 Klueger ..... 292/336.3
5,253,906 A * 10/1993 Rogers et al. ..... 292/216
5,492,379 A * 2/1996 Staser et al. ..... 292/336.3
5,584,516 A 12/1996 Cetnar
5,709,498 A * 1/1998 Sova et al. ..... 403/196
5,749,611 A 5/1998 Watson et al.
5,855,096 A * 1/1999 Staser et al. ..... 49/503
5,934,817 A * 8/1999 Kim et al. ..... 403/196
6,241,294 B1 6/2001 Young et al.
6,514,027 B1 2/2003 Yiu et al.
6,880,867 B2 4/2005 Schoen et al.
2005/0127682 A1 6/2005 Cetnar et al.

FOREIGN PATENT DOCUMENTS

JP 2002213131 7/2002

* cited by examiner

*Primary Examiner* — Carlos Lugo
(74) *Attorney, Agent, or Firm* — Raymond Coppiellie; Price Heneveld LLP

(57) ABSTRACT

A vehicle door latch assembly includes a latch rod coupled to a latch mechanism and operable by a door handle to unlatch the latch mechanism. The latch assembly may include a release clip operably connected to the latch mechanism for releasably connecting the latch rod to the latch mechanism. A latch rod release bracket may be mounted to an inner surface of a vehicle door, and include an extension having a wedge-shaped area adjacent a lower portion thereof engageable with a detent on the release clip to disengage the release clip and thereby release the latch rod during a side impact event. Also provided is a method of releasing a latch rod from a latching mechanism in a vehicle door during a side impact event, with the method using the latch rod release bracket described above.

16 Claims, 7 Drawing Sheets

VEHICLE DOOR LATCHING ASSEMBLY INCLUDING LATCH ROD DECOUPLING MECHANISM

BACKGROUND OF INVENTION a. Field of Invention

The invention relates generally to vehicle door latch assemblies, and, more particularly, to an apparatus and method for decoupling a vehicle door latch rod from its latch mechanism in the event of a side impact.

b. Description of Related Art

Automobile door latch assemblies generally include a handle provided on the interior and exterior of the vehicle door, and operably connected to a latch mechanism by means of a latch rod. As is well known in the art, the latch assembly is operated by pulling the handle and thereby activating the latch mechanism to release the door from a latched to an unlatched configuration.

In the event of a side impact, the operation of automobile doors and latches is governed by regulations which generally require all side and rear doors, hatches, and liftgates to remain closed during an impact sequence. After the impact, for vehicles with two doors per seating row, regulations require one side door per seating row to be operable (i.e. opened) without the use of tools. Further, for vehicles with seating rows with one or no doors, a sufficient number of doors in the vehicle should be operable without the use of tools to provide for all occupant egress.

In the art, there presently exist a variety of vehicle door latching assembly designs which are directed towards the operation of a door latch during a side impact. For example, referring to FIGS. 1-4 of U.S. Pat. No. 6,880,867 to Schoen, there is discloses a link rod 30 flexibly connecting an exterior door handle 10 of a motor vehicle and a door latching mechanism 20 to prevent actuation of the door latching mechanism as the result of a lateral collision. The link rod includes a first section 31 connected to the vehicle door handle, and a second section 32 operatively connected to the door latching mechanism, with a lateral connector 33 operatively connecting the first section to the second section. Referring to FIGS. 3 and 4, in the event of a lateral impact in the direction indicated by X, the inertia of door handle 10 effectively lifts the handle in the direction Y. As illustrated in FIG. 4, during a lateral impact, door handle 10 is effectively displaced in direction Y and link rod 30 is effectively displaced in direction Z resulting from the effective lateral displacement of lateral connector 33. The lateral displacement of link rod 30 results in a break between first section 31 and second section 32 that decouples the door handle from latch mechanism 20. Compared to conventional solid link rods, the sectioned link rod disclosed in Schoen purportedly prevents actuation of latch mechanism 20 to thereby allow the vehicle door to remain secured.

However, referring to FIGS. 3 and 4 of Schoen, it can be seen that link rod 30 remains attached to latch mechanism 20 during the side impact sequence. In the event of a severe side impact or an impact at an angle transverse (i.e. a roll-over or other unconventional impact) to the intended impact axis X, because of the fact that link rod 30 remains attached to latch mechanism 20, there remains a possibility of the rod actuating the latch mechanism to unlatch the vehicle door. Further, in the event of deterioration of the lateral connector due to wear and other environmental factors, there likewise remains the possibility of the rod actuating the latch mechanism due to its continued attachment with the latch mechanism during the side impact event.

Thus, operation of the noted existing vehicle door latching assembly of Schoen would likely not be in compliance with effective regulations which require all side and rear doors, hatches, and liftgates to remain closed during an impact sequence.

Accordingly, there remains a need for a vehicle door latch assembly which reliably enables detachment or inoperability of a door latch rod from its latch mechanism in the event of a side impact. There also remains a need for a vehicle door latch assembly which is economically feasible to manufacture and install in a fast-paced assembly line, and which is readily usable with existing door latch assemblies to modify the same for compliance with effective side impact regulations.

SUMMARY OF INVENTION

The invention solves the problems and overcomes the drawbacks and deficiencies of prior art vehicle door latch assembly designs by providing a novel apparatus and method for reliably decoupling a vehicle door latch rod from its latch mechanism in the event of a side impact.

Thus, an exemplary aspect of the present invention is to provide a vehicle door latch assembly which is usable with existing door latch assembly designs.

Another aspect of the present invention is to provide a vehicle door latch assembly which reliably enables detachment or inoperability of a door latch rod from its latch mechanism in the event of a side impact.

Yet another aspect of the present invention is to provide a vehicle door latch assembly which enables continued operation of another vehicle door (i.e. a non-impacted door) after a side impact event, without the use of tools for compliance with effective side impact regulations.

The invention achieves the aforementioned exemplary aspects by providing a vehicle door latch assembly including a latch rod coupled to a latch mechanism and operable by a door handle to unlatch the latch mechanism. The vehicle door latch assembly may further include a release clip operably connected to the latch mechanism for releasably connecting the latch rod to the latch mechanism, and a latch rod release bracket mounted to an inner surface of a vehicle door. The latch rod release bracket may include an extension having a wedge-shaped area adjacent a lower portion thereof engageable with a detent on the release clip to disengage the release clip and thereby release the latch rod during a side impact event.

For the vehicle door latch assembly described above, the assembly may further include a U-shaped hook adjacent an upper portion of the extension for engaging the latch rod during the side impact event and lifting the latch rod away from the release clip. Alternatively, the U-shaped hook may be shaped to move the latch rod away from the release clip, or instead, a protrusion may be provided to move the latch rod away from the release clip. The latch rod release bracket may further include a base for mounting the latch rod release bracket to the inner surface of the vehicle door, with the extension being disposed at an angle relative to the base for engagement with the detent during the side impact event. The extension may further include a wing disposed adjacent the wedge-shaped area for preventing the latch rod release bracket from moving past the release clip without disengaging the release clip during the side impact event.

The invention also provides a vehicle door latch assembly for releasing a latch rod from a latching mechanism during a side impact event. The assembly may include a latch rod release bracket mounted to a vehicle door. The latch rod release bracket may include an extension engageable with a detent on a release clip for grasping the latch rod, to disengage the release clip and thereby release the latch rod from the latching mechanism during the side impact event.

For the vehicle door latch assembly described above, the extension may include a wedge-shaped area adjacent a lower portion thereof and engageable with the detent. The extension may further include a wing disposed adjacent the wedge-shaped area for preventing the latch rod release bracket from moving past the release clip without disengaging the release clip during the side impact event. A U-shaped hook may be provided adjacent an upper portion of the extension for engaging the latch rod during the side impact event and lifting the latch rod away from the release clip. As discussed above, the U-shaped hook may be shaped to move the latch rod away from the release clip, or instead, a protrusion may be provided to move the latch rod away from the release clip. The latch rod release bracket may further include a base for mounting the latch rod release bracket to an inner surface of the vehicle door, with the extension being disposed at an angle relative to the base for engagement with the detent during the side impact event.

The invention yet further provides a method of releasing a latch rod from a latching mechanism in a vehicle door during a side impact event. The method may include the step of mounting a latch rod release bracket to the vehicle door, with the latch rod release bracket including an extension engageable with a detent on a release clip for grasping the latch rod, to disengage the release clip and thereby releasing the latch rod from the latching mechanism during the side impact event.

For the method described above, the method may also include the step of providing the extension with a wedge-shaped area adjacent a lower portion thereof and engageable with the detent. The extension may further include a wing disposed adjacent the wedge-shaped area for preventing the latch rod release bracket from moving past the release clip without disengaging the release clip during the side impact event. The method may include the step of providing the assembly with a U-shaped hook adjacent an upper portion of the extension for engaging the latch rod during the side impact event and lifting the latch rod away from the release clip. The U-shaped hook may be shaped to move the latch rod away from the release clip, or instead, a protrusion may be provided to move the latch rod away from the release clip. The method may also include the step of providing the latch rod release bracket with a base for mounting the latch rod release bracket to an inner surface of the vehicle door, with the extension being disposed at an angle relative to the base for engagement with the detent during the side impact event.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
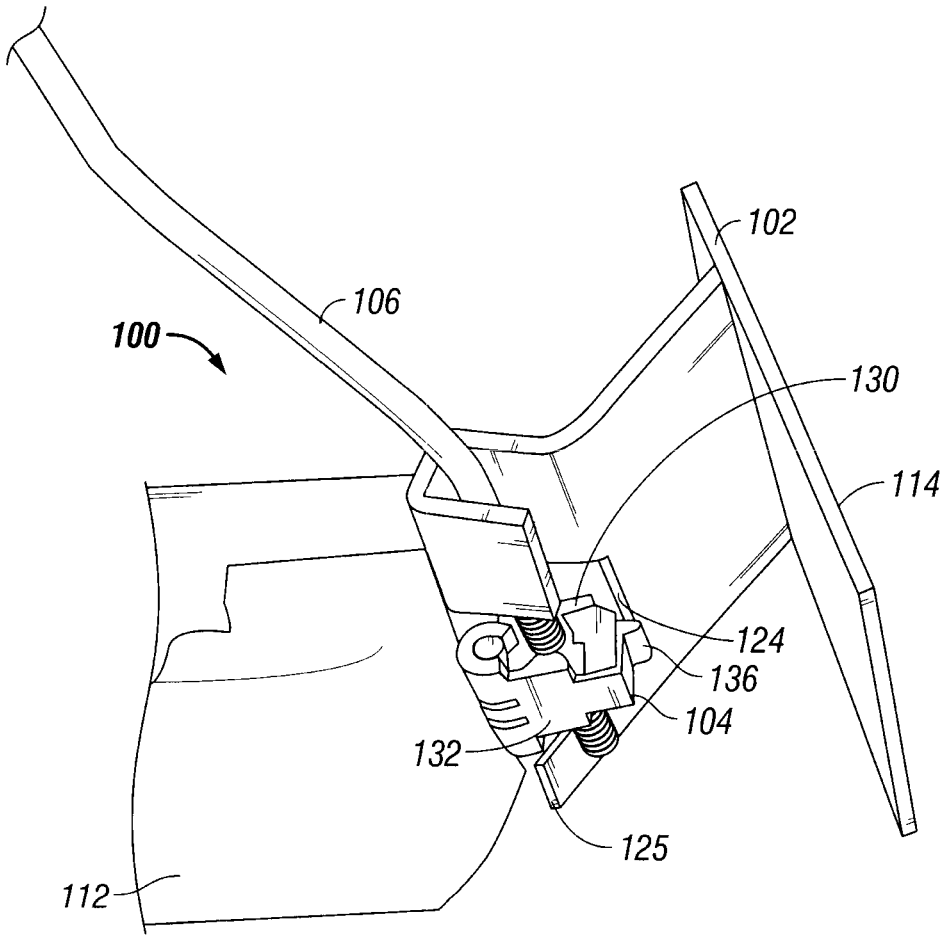
FIG. 1 is an isometric view of a vehicle door latch assembly according to the present invention, including a latch rod release bracket disposed adjacent a release clip and latch rod.

Referring now to the drawings wherein like reference numerals designate corresponding parts throughout the several views, FIGS. 1-4C illustrate a vehicle door latch assembly according to the present invention, generally designated "door latch assembly 100," and its operation during a side impact event.

Referring to FIG. 1, door latch assembly 100 is illustrated in a partially assembled configuration. Generally, door latch assembly 100 may include a latch rod release bracket 102 assembled onto a release clip 104 and a compression latch rod 106. Further, referring to FIG. 2, door latch assembly 100 is illustrated in an assembled configuration with the noted elements mounted on the inner surface of a vehicle door 110, and latch rod 106 engaged with latch mechanism 112.

Referring next to FIGS. 1-3D, the elements of door latch assembly 100 will now be described in detail.

Specifically, as shown in FIGS. 3A-3D, latch rod release bracket 102 of door latch assembly 100 may generally include a base plate 114 fixedly mounted on the inner surface of vehicle door 110 by means of welding, riveting or other means known in the art. An extension 116 may be disposed at an angle relative to base plate 114, and in the particular embodiment illustrated, extension 116 may be disposed at an approximately 60° angle. Of course, those skilled in the art would readily appreciate in view of this disclosure that the angle of extension 116 relative to base plate 114 may be adjusted based upon the geometric relation between the inner surface of door 110 and latch rod 106.

Latch rod release bracket 102 may further include a U-shaped hook 118 adjacent an upper edge 120 thereof, with hook 118 being disposable around latch rod 106 as shown in FIG. 1. Lower edge 122 of latch rod release bracket 102 may be shaped as a wedge 124 for engagement with release clip 104 during a side impact event, as discussed in greater detail below. A wing 125 may be disposed adjacent wedge 124 for effectively preventing bracket 102 from moving past release clip 104 without disengaging the clip during a side impact event, and for adding robustness to the overall structure of bracket 102, as also discussed in greater detail below.

Latch rod release bracket 102 may be formed of high strength steel or other high strength materials known in the art, for permitting transfer of a side impact load and for disengaging latch rod 106 without significant deformation thereof.

Figure 2:
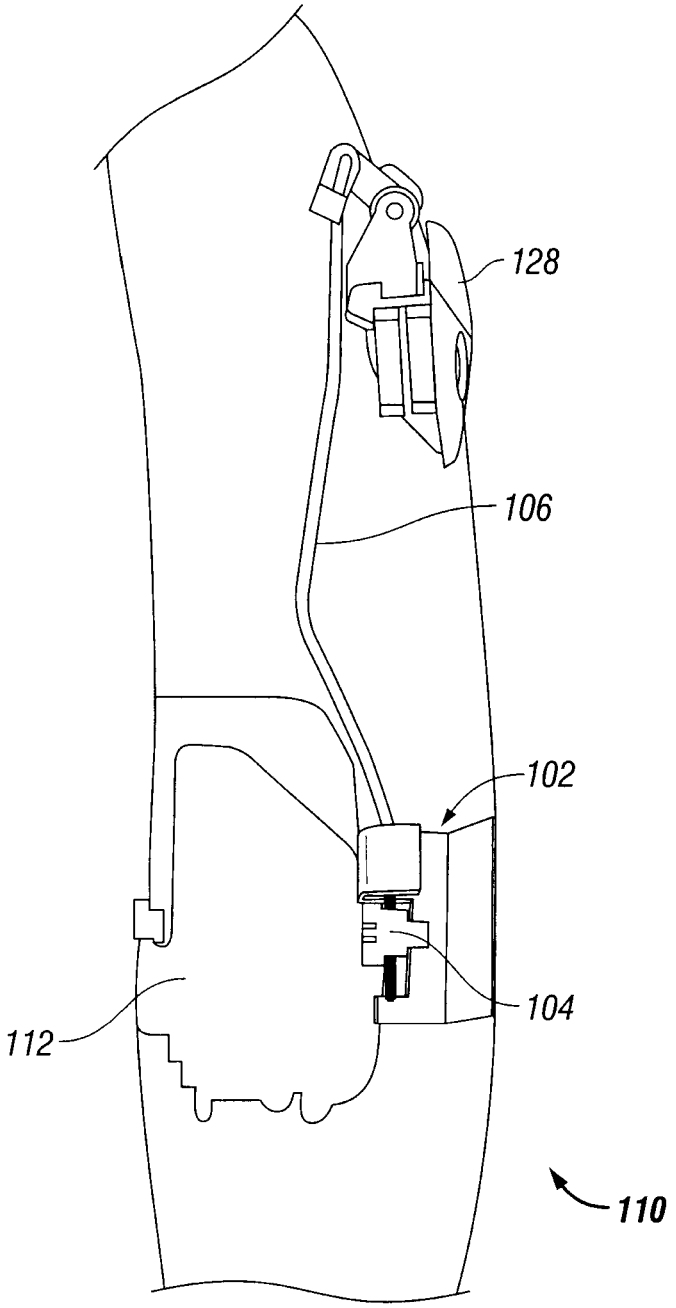
FIG. 2 is a view illustrative of the vehicle door latch assembly of FIG. 1 attached to a vehicle door.
Figure 3A:
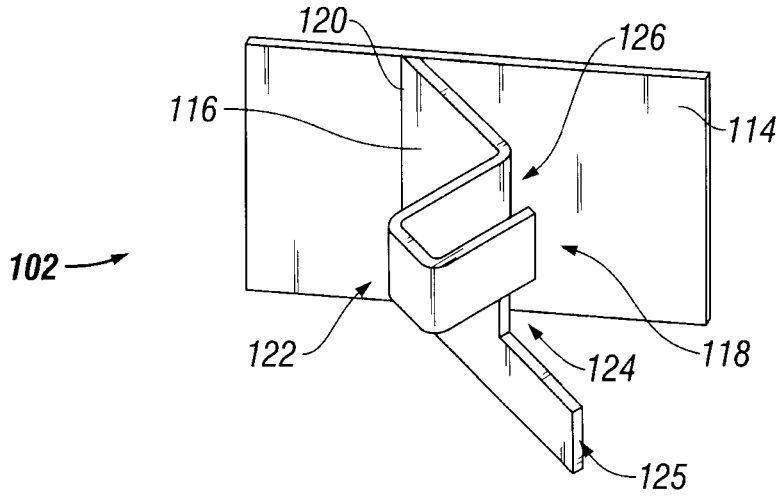
FIGS. 3A-3D are respectively isometric, front, side and top views of the latch rod release bracket of FIG. 1.
Figure 3B:
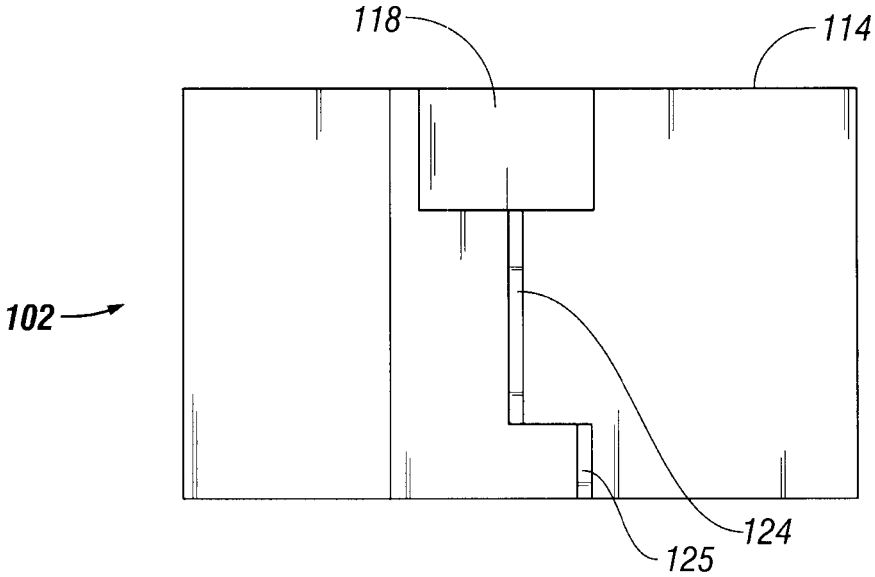
Figure 3C:
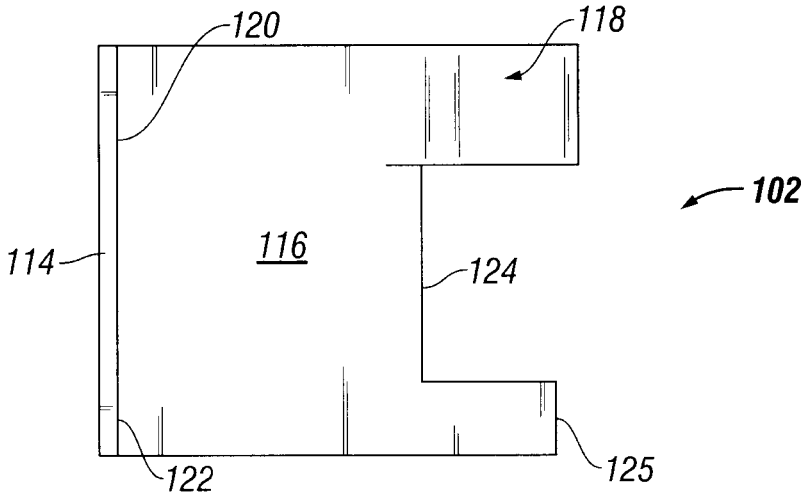
Figure 3D:
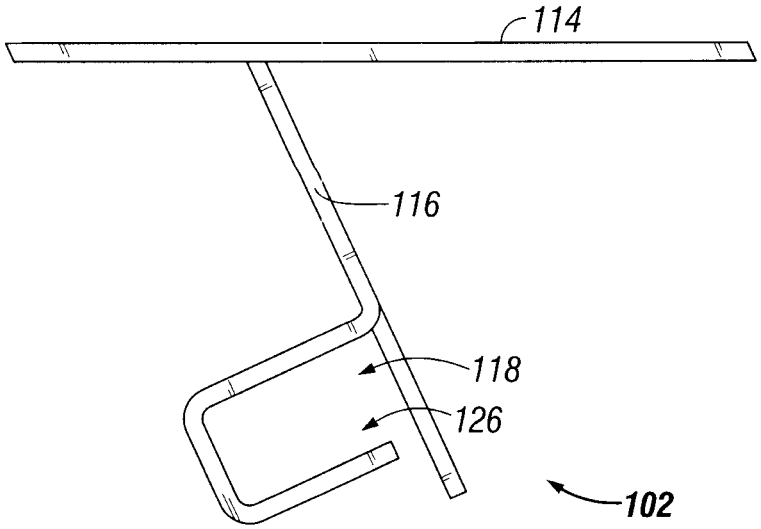

As shown in FIGS. 1 and 2, release clip 104 is illustrated mounted to latch mechanism 112 with latch rod 106 releasably gripped therein. Clip 104 may be a "Mazda clip" or other such clips known in the automobile art for connecting a handle (i.e. handle 128) to the latch mechanism (i.e. mechanism 112). As shown, release clip 104 may be mounted to latch mechanism 112 and serve as a mechanical interface between latch rod 106 and latch mechanism 112.

Release clip 104 may generally include a base portion 130 attached by a flexible hinge (not shown) to a cap portion 132. Base portion 130 and cap portion 132 may be disposable between open (see FIGS. 4B and 4C) and locked (see FIGS. 1 and 4A) positions for retaining latch rod 106 as shown. The inner facing surfaces of cap portion 132 and base portion 130 may each include threads 138 for complementary engagement with external threads 134 on latch rod 106.

In order to open release clip 104 and thus release latch rod 106 therefrom, a prying-type force-F may be applied to detent 136 provided on cap portion 132 to thus disengage cap portion 132 from base portion 130.

Referring to FIGS. 1 and 2, latch mechanism 112 may be a standard latch mechanism operable by pulling latch rod 106 upwards in the direction of FIG. 2 by means of handle 128 to unlatch door 110, as is known in the art.

The design and assembly of door latch assembly 100 will now be described in detail with reference to FIGS. 1-3D.

Specifically, as shown in FIGS. 1 and 2, latch rod release bracket 102 may first be configured for optimal engagement relative to latch rod 106 and release clip 104. In this regard, the angle of extension 116 relative to base plate 114 may be adjusted based upon the geometric relation between the inner surface of vehicle door 110, latch rod 106 and release clip 104. U-shaped hook 118 may be designed such that area 126 allows for un-impeded movement of latch rod 106 for actuation of latch mechanism 112 by means of handle 128 on door 110. Further, wedge 124 on lower edge 122 of bracket 102 may be shaped and positioned for engagement with release clip 104 during a side impact event.

With the sub-components of latch rod release bracket 102 designed as discussed above, bracket 102 may be fixedly attached to the inner surface of vehicle door 110.

The operation of door latch assembly 100 will now be described in detail with reference to FIGS. 1, 2 and 4A-4C.

Figure 4A:
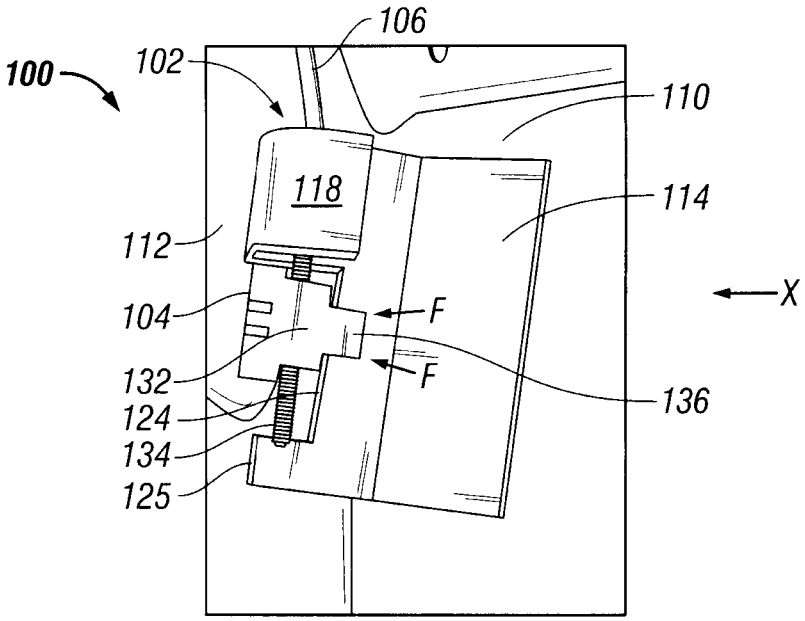
FIG. 4A is a view illustrative of the assembled configuration for the vehicle door latch assembly components of FIG. 1 just prior to a side impact.
Figure 4B:
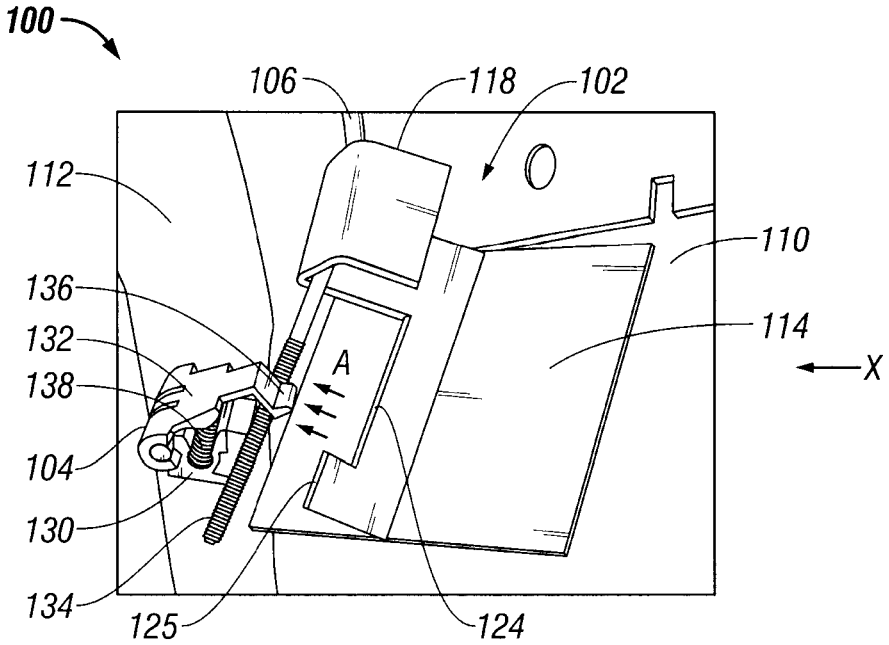
FIG. 4B is a view illustrative of the assembled configuration for the vehicle door latch assembly components of FIG. 1 during a side impact.
Figure 4C:
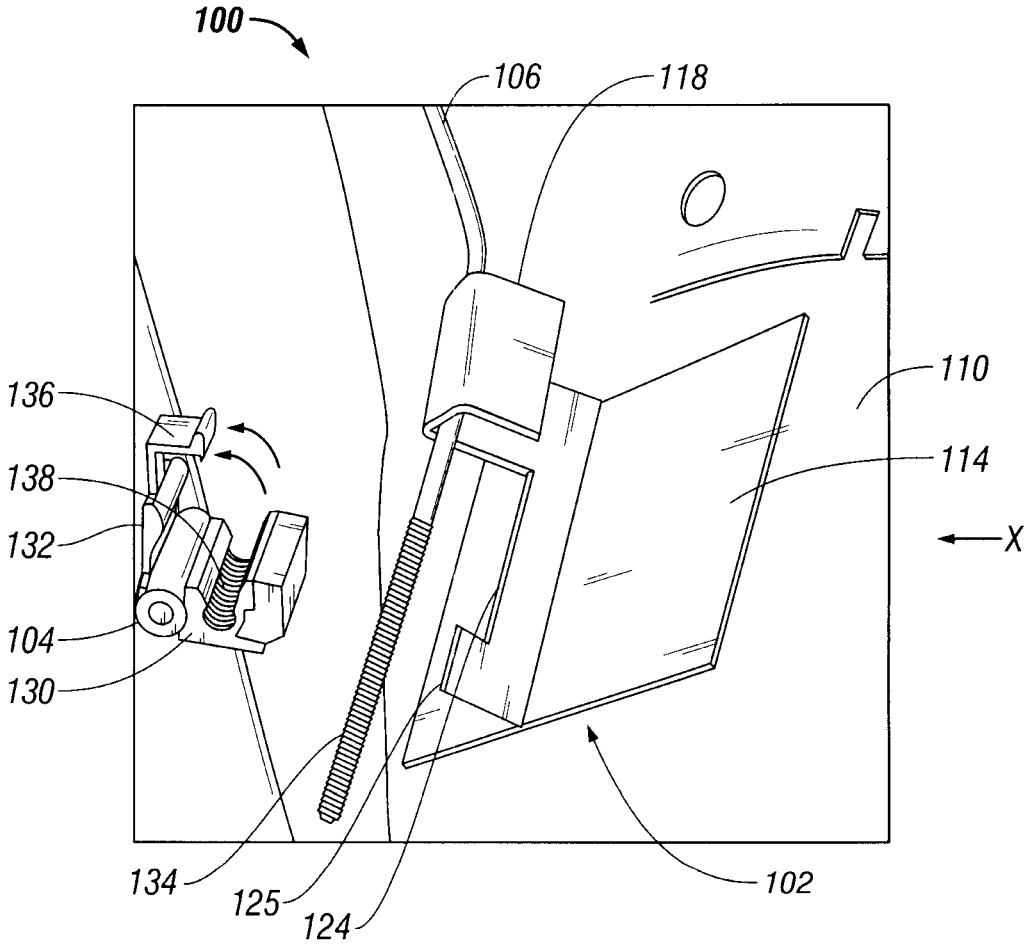
FIG. 4C is another view illustrative of the assembled configuration for the vehicle door latch assembly components of FIG. 1 during the side impact sequence.
Figure 5:
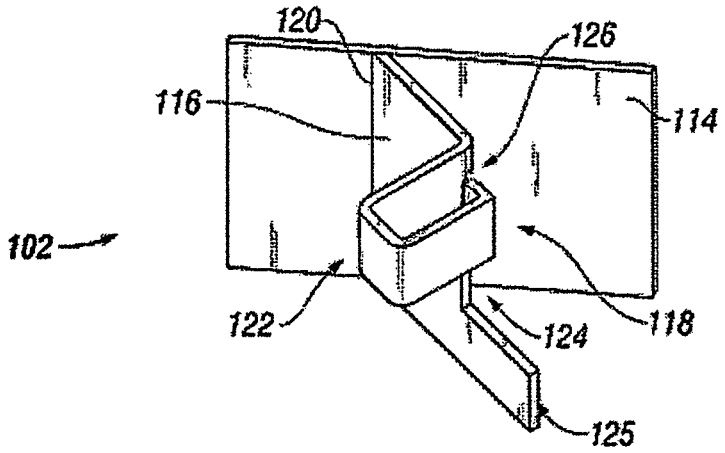
FIG. 5 is an isometric view of the latch rod release bracket of FIG. 1, illustrating an exemplary protrusion.

Referring to FIGS. 4A-4C, the operation of door latch assembly 100 is illustrated during a side impact event, within an exemplary time range of time (t)=1 ms before impact up to t=25 ms after impact. As shown in FIG. 4A, at t=1 ms before impact, assembly 100 is illustrated mounted to the inner surface of vehicle door 110, with latch mechanism 112 disposed on the left side thereof. For a side impact occurring generally in the X-direction or a direction transverse to the X-direction, at t=1 ms, release clip 104 is illustrated mounted to latch mechanism 112 with latch rod 106 connected by release clip 104 as discussed above.

Referring next to FIG. 4B, at t=21 ms, as the side impact is proceeding generally in the X-direction, wedge 124 of latch rod release bracket 102 contacts detent 136 to exert the force-F (see FIG. 4A) in the direction of arrows-A to open cap portion 132 and base portion 130 of release clip 104, to thus release latch rod 106 from clip 104. In this manner, latch rod 106 is thereby disengaged from latch mechanism 112 to prevent operation of the latch mechanism as well as unintended opening of door 110 during the impact event. Referring next to FIG. 4C, in order to account for the possibility that a side impact may not result in wedge 124 of latch rod release bracket 102 contacting detent 136, or alternatively, to assure detachment of latch rod 106 from latch mechanism 112 due to the potential continued engagement of the exterior threads 134 with internal threads 138 of release clip 104, at t=25 ms, U-shaped hook 118 lifts latch rod 106 upwards to place rod 106 in tension, instead of its initial operational compression state. Further, if a side impact did indeed result in wedge 124 contacting detent 136 as intended, U-shaped hook 118 effectively "kicks" latch rod 106 out from its assembled position from within release clip 104 to likewise render latch rod 106 inoperable.

In this manner, the present invention door latch assembly provides two distinct mechanisms for disengagement of latch rod 106 from latch mechanism 112. First, the provision of wedge 124 contacting detent 136 to open cap portion 132 and base portion 130 to release latch rod 106 from clip 104 provides a first mechanism for disengaging latch rod 106 from latch mechanism 112. In this regard, wing 125 disposed adjacent wedge 124 also effectively prevents bracket 102 from moving past release clip 104 without disengaging the clip during a side impact event. Secondly, the provision of U-shaped hook 118 lifting latch rod 106 upwards to essentially pull rod 106 from release clip 104, and thus disengage latch rod 106 from latch mechanism 112, provides a second distinct mechanism. As readily evident, the first and second release mechanisms act in concert to assure release of latch rod 106 from latch mechanism 112, and thus assure compliance with effective side impact regulations.

Upon termination of the side impact event, since deformation of a vehicle door 110 is required for operation of door latch assembly 100, assembly 100 reliably enables continued operation of the non-impacted vehicle doors post impact, without the use of tools for compliance with effective side impact regulations.

Those skilled in the art would readily appreciate in view of this disclosure that various modifications may be made to door latch assembly 100 without departing from the scope of the present invention. For example, while door latch assembly 100 has been illustrated as being operable with a release clip 104 and a latch rod 106, latch rod release bracket 102 may be readily used with other latch designs which use latch rods, for decoupling the latch rod from its latch mechanism during deformation of a door. Such designs could incorporate doors for automotive, residential and other uses. Yet further, the concept of wedge 124 and U-shaped hook 118 provided on latch rod release bracket 102 may be readily modified to features of different shapes for opening of a release clip and/or forced detachment or extension of a latch rod during door deformation.

To summarize, the present invention thus provides a novel apparatus and method for decoupling a vehicle door latch rod from its latch mechanism in the event of a side impact. As noted above, door latch assembly 100, which includes latch rod release bracket 102, is usable with existing door latch assemblies in that bracket 102 may be designed to engage detent 136 of release clip 104 and further lift an existing latch rod 106 by means of U-shaped hook 118 during a side impact. Once designed, bracket 102 may be mounted to an existing vehicle door for compliance with effective side impact regulations. Yet further, because of the provision of the first and second release mechanisms which act in concert, the present invention door latch assembly reliably enables detachment or inoperability of latch rod 106 from its latch mechanism 112 in the event of a side impact. Upon termination of the side impact event, since door latch assembly 100 requires door deformation for its intended operation, assembly 100 thus reliably enables continued operation of non-impacted doors post impact, without the use of tools for compliance with effective side impact regulations.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A vehicle door latch assembly comprising:

a latch rod coupled to a latch mechanism and operable by a door handle to unlatch the latch mechanism;

a release clip operably connected to the latch mechanism for releasably connecting the latch rod to the latch mechanism; and a latch rod release bracket mounted to an inner surface of a vehicle door, said latch rod release bracket including an extension, said extension including a wedge-shaped area adjacent a lower portion thereof engageable with a detent on the release clip to disengage the release clip and thereby release the latch rod during a side impact event.

2. A vehicle door latch assembly according to claim 1, said assembly further comprising a U-shaped hook adjacent an upper portion of said extension for engaging the latch rod during the side impact event and lifting the latch rod away from the release clip.

3. A vehicle door latch assembly according to claim 1, said assembly further comprising a U-shaped hook adjacent an upper portion of said extension for engaging the latch rod during the side impact event and moving the latch rod away from the release clip.

4. A vehicle door latch assembly comprising:

a latch rod coupled to a latch mechanism and operable by a door handle to unlatch the latch mechanism;

a release clip operably connected to the latch mechanism for releasably connecting the latch rod to the latch mechanism;

a latch rod release bracket mounted to an inner surface of a vehicle door, said latch rod release bracket including an extension, said extension including a wedge-shaped area adjacent a lower portion thereof engageable with a detent on the release clip to disengage the release clip and thereby release the latch rod during a side impact event; and a protrusion adjacent an upper portion of said extension for engaging the latch rod during the side impact event and moving the latch rod away from the release clip.

5. A vehicle door latch assembly according to claim 1, said latch rod release bracket further comprising a base for mounting said latch rod release bracket to the inner surface of the vehicle door, said extension being disposed at an angle relative to the base for engagement with the detent during the side impact event.

6. A vehicle door latch assembly according to claim 1, said extension further comprising a wing disposed adjacent said wedge-shaped area for preventing said latch rod release bracket from moving past the release clip without disengaging the release clip during the side impact event.

7. A vehicle door latch assembly for releasing a latch rod from a latching mechanism during a side impact event, said assembly comprising:

a latch rod release bracket mounted to a vehicle door, said latch rod release bracket including an extension engageable with a detent on a release clip for grasping the latch rod to disengage the release clip and thereby release the latch rod from the latching mechanism during the side impact event;

wherein said extension including a wedge-shaped area adjacent a lower portion thereof and engageable with the detent; and a U-shaped hook adjacent an upper portion of said extension for engaging the latch rod during the side impact event and lifting the latch rod away from the release clip.

8. A vehicle door latch assembly for releasing a latch rod from a latching mechanism during a side impact event, said assembly comprising:

a latch rod release bracket mounted to a vehicle door, said latch rod release bracket including an extension engageable with a detent on a release clip for grasping the latch rod to disengage the release clip and thereby release the latch rod from the latching mechanism during the side impact event;

wherein said extension including a wedge-shaped area adjacent a lower portion thereof and engageable with the detent; and a U-shaped hook adjacent an upper portion of said extension for engaging the latch rod during the side impact event and moving the latch rod away from the release clip.

9. A vehicle door latch assembly for releasing a latch rod from a latching mechanism during a side impact event, said assembly comprising:

a latch rod release bracket mounted to a vehicle door, said latch rod release bracket including an extension engageable with a detent on a release clip for grasping the latch rod to disengage the release clip and thereby release the latch rod from the latching mechanism during the side impact event;

wherein said extension including a wedge-shaped area adjacent a lower portion thereof and engageable with the detent; and a protrusion adjacent an upper portion of said extension for engaging the latch rod during the side impact event and moving the latch rod away from the release clip.

10. A method of providing a latch rod releasable from a latching mechanism in a vehicle door, said method comprising the step of:

mounting a latch rod release bracket to the vehicle door, said latch rod release bracket including an extension engageable with a detent on a release clip for grasping the latch rod to disengage the release clip and thereby release the latch rod from the latching mechanism during a side impact event.

11. A method according to claim 10, further comprising the step of providing said extension with a wedge-shaped area adjacent a lower portion thereof and engageable with the detent.

12. A method according to claim 11, further comprising the step of providing said assembly with a U-shaped hook adjacent an upper portion of said extension for engaging the latch rod during the side impact event and lifting the latch rod away from the release clip.

13. A method according to claim 11, further comprising the step of providing said assembly with a U-shaped hook adjacent an upper portion of said extension for engaging the latch rod during the side impact event and moving the latch rod away from the release clip.

14. A method of providing a latch rod releasable from a latching mechanism in a vehicle door during a side impact event, said method comprising the step of:

mounting a latch rod release bracket to the vehicle door, said latch rod release bracket including an extension engageable with a detent on a release clip for grasping the latch rod to disengage the release clip and thereby release the latch rod from the latching mechanism during the side impact event;

providing said extension with a wedge-shaped area adjacent a lower portion thereof and engageable with the detent; and providing said assembly with a protrusion adjacent an upper portion of said extension for engaging the latch rod during the side impact event and moving the latch rod away from the release clip.

15. A method according to claim 10, further comprising the step of providing said latch rod release bracket with a base for mounting said latch rod release bracket to an inner surface of the vehicle door, said extension being disposed at an angle relative to the base for engagement with the detent during the side impact event.

16. A method according to claim 11, further comprising the step of providing said extension with a wing disposed adjacent said wedge-shaped area for preventing said latch rod release bracket from moving past the release clip without disengaging the release clip during the side impact event.

* * * * *